US008801406B2

(12) United States Patent
Liu et al.

(10) Patent No.: US 8,801,406 B2
(45) Date of Patent: Aug. 12, 2014

(54) BLOWER

(75) Inventors: Xiang Liu, Zhongshan (CN); Chuping Lu, Zhongshan (CN); Xiongcheng Wang, Zhongshan (CN); Sanzeng Liang, Zhongshan (CN)

(73) Assignee: Zhongshan Broad-Ocean Motor Co., Ltd., Zhongshan (CN)

( * ) Notice: Subject to any disclaimer, the term of this patent is extended or adjusted under 35 U.S.C. 154(b) by 238 days.

(21) Appl. No.: 13/339,368

(22) Filed: Dec. 28, 2011

(65) Prior Publication Data

US 2012/0121409 A1 May 17, 2012

Related U.S. Application Data

(63) Continuation-in-part of application No. 12/581,182, filed on Oct. 19, 2009, now abandoned.

(30) Foreign Application Priority Data

Nov. 27, 2008 (CN) ..... 2008 2 0204500 U

(51) Int. Cl.
*F04B 35/04* (2006.01)

(52) U.S. Cl.
USPC ..... 417/424.1; 417/423.14; 417/423.15

(58) Field of Classification Search
CPC ..... F04D 5/00; F04D 5/002; F04D 5/007; F04D 29/4226
USPC ..... 417/410.1, 423.1, 423.14, 423.15, 417/424.1; 415/206
See application file for complete search history.

(56) References Cited

U.S. PATENT DOCUMENTS

| | | | | |
|---|---|---|---|---|
| 5,341,795 | A * | 8/1994 | Chou et al. | 126/110 R |
| 5,536,140 | A * | 7/1996 | Wagner et al. | 415/119 |
| 5,620,302 | A * | 4/1997 | Garrison et al. | 415/169.2 |
| RE37,261 | E * | 7/2001 | Schmider et al. | 417/423.7 |
| 6,511,290 | B1 * | 1/2003 | Gatley, Jr. | 415/212.1 |
| 6,553,923 | B2 * | 4/2003 | Gatley, Jr. | 110/162 |
| 6,575,701 | B2 * | 6/2003 | Kamiya et al. | 415/206 |
| 6,655,926 | B2 * | 12/2003 | Wang et al. | 417/234 |
| 6,908,281 | B2 * | 6/2005 | Lyons et al. | 415/206 |
| 6,929,448 | B1 * | 8/2005 | Lyons et al. | 415/204 |
| 7,278,823 | B2 * | 10/2007 | Platz | 415/204 |
| RE40,818 | E * | 7/2009 | Gatley, Jr. | 110/162 |
| 2005/0047945 | A1 * | 3/2005 | Metzger | 417/423.14 |
| 2005/0121996 | A1 * | 6/2005 | Lopatinsky et al. | 310/268 |
| 2006/0093500 | A1 * | 5/2006 | Liang | 417/423.1 |
| 2006/0177322 | A1 * | 8/2006 | Lipa et al. | 417/423.1 |
| 2007/0154333 | A1 * | 7/2007 | Kanai et al. | 417/423.1 |

* cited by examiner

*Primary Examiner* — Charles Freay
*Assistant Examiner* — Alexander Comley
(74) *Attorney, Agent, or Firm* — Matthias Scholl P.C.; Matthias Scholl

(57) ABSTRACT

A blower including a blower volute, a blower motor, and a fan wheel. The blower motor is disposed at the top of the blower volute. The fan wheel is disposed inside the blower volute and connected to the blower motor. The blower volute comprises an air inlet, an air outlet, a cover body, and a bottom cover. A plurality of installation parts is disposed at an outer side of the cover body. The bottom cover and the cover body are embedded with each other and welded together or stuck together. The blower has a simple connection structure, high generality, friendly installation, and low cost.

4 Claims, 17 Drawing Sheets

BLOWER

CROSS-REFERENCE TO RELATED APPLICATIONS

This application is a continuation-in-part of U.S. Ser. No. 12/581,182 filed on Oct. 19, 2009, now pending, which is based on Chinese Patent Application No. 200820204500.7, filed Nov. 27, 2008. The contents of all of the aforementioned applications, including any intervening amendments thereto, are incorporated herein by reference.

BACKGROUND OF THE INVENTION

1. Field of the Invention

The invention relates to a blower.

2. Description of the Related Art

A conventional blower volute is composed of a cover body and a bottom cover, in which the bottom cover is connected to the cover body using either screws or bolts. Because the bottom cover and the cover body are connected together by screws or bolts, thus it has a complex installation structure and high cost. Especially since the interface between the bottom cover and the cover body is fixed, the original bottom cover is not universal. Moreover, as blower volutes are generally arranged on an outer wall of the bottom cover, therefore, to meet different requirements for installation and steering position of blower volutes from different customers, bottom covers with different specifications have to be produced to cooperate with cover bodies, which results in a high production and management cost.

SUMMARY OF THE INVENTION

In view of the above-described problems, it is one objective of the invention to provide a blower that has a simple connection structure, high generality, friendly installation, and low cost.

To achieve the above objective, in accordance with one embodiment of the invention, there is provided a blower comprising a blower volute, a blower motor, and a fan wheel, wherein the blower motor is disposed at the top of the blower volute; the fan wheel is disposed inside the blower volute and connected to the blower motor; the blower volute comprises an air inlet, an air outlet, a cover body, and a bottom cover; a plurality of installation parts are disposed at an outer side of the cover body; and the bottom cover and the cover body are embedded with each other and welded together or stuck together.

In a class of this embodiment, the bottom cover is directly embedded into an inner wall of the bottom of the cover body; the inner wall is arranged with steps and the top of the bottom cover supports the steps.

In a class of this embodiment, both the bottom cover and the inner wall have a circular shape and the bottom of the bottom cover is aligned with the bottom of the cover body.

In a class of this embodiment, the air outlet is disposed at one side of the cover body.

In a class of this embodiment, the bottom cover comprises a circular base plate embedded into the inner wall of the bottom of the cover body and a convex ring body located in the middle of the circular base plate; the air inlet is disposed in the middle of the circular base plate and the convex ring body is located at outer side of the air inlet.

In a class of this embodiment, a bottom surface of the circular base plate and outer edges of the air inlet are provided with a plurality of reinforcing ribs.

In a class of this embodiment, the fan wheel comprises an upper disk, a lower disk, and a plurality of fan blades disposed between the upper disk and the lower disk; a through hole is arranged in the middle of the lower disk and the convex ring body extends into the through hole.

In a class of this embodiment, a shaft sleeve is arranged in the middle of the upper disk and the shaft sleeve is tightly connected to a shaft extension end of the rotating shaft of the blower motor; the shaft sleeve is embedded into a central through hole disposed at the top of the cover body; the top inner wall of the cover body is arranged with a convex portion located at outer side of the shaft sleeve and closed to the end surface of the upper disk; the outer edge of the upper disk is arranged with a plurality of fan blades; the upper disk and the lower disk are either welded together or stuck together with the number of the fan blades of 8-12 pieces.

In a class of this embodiment, the cover body is arranged with at least one drainage hole, a rib is arranged both on the inner wall of the cover body bottom and at both top sides of the drainage hole; the rib introduces the condensed water generated in the blower volute out through the drainage hole.

In a class of this embodiment, the drainage hole comprises a gully hole, a drain outlet, and a diversion section located between the gully hole and the drain outlet. The gully hole, the drain outlet, and the diversion section have the same cross-sectional shape and size; the rib is arranged at the side of the gully hole and perpendicularly connected to the side edge of the gully hole.

In a class of this embodiment, the outer edge of the diversion section forms a tubular body extending out of the blower volute and the reinforcing rib is arranged outside the tubular body.

Advantages of the invention are summarized below:

1) by arranging a plurality of installation parts at outer side of the cover body of the blower volute, the circular bottom cover and the cover body are either welded together or stuck together, which is characterized in that it has a simple structure and is cost-effective, installation friendly and stable. Thus it realizes a universal use of the bottom cover and meets different requirements for installation and steering position of the blower volute from different customers and greatly reduces the costs of production and management;
2) as a convex ring body is arranged on the bottom cover, a through hole is arranged in the middle of the lower disk of the fan wheel and the convex ring body extends into the through hole to fill the gap, the fan wheel can almost absorb the air flowing from the air inlet and it increases the air intake quantity and improves the blowing efficiency of the blower;
3) a shaft sleeve is arranged in the middle of the upper disk, the shaft sleeve is tightly connected to the shaft extension end of the rotating shaft of the blower motor and the shaft sleeve is embedded into the central through hole on top of the cover body; the top inner wall of the cover body is also arranged with a convex portion located at outer side of the shaft sleeve and closed to the end surface of the upper disk, which has a good sealing effect for the shaft sleeve and the shaft extension end of the rotating shaft, thus effectively prevent the shaft sleeve and the rotating shaft from being corroded by condensed water vapor so that the shaft needs not to be made of corrosion resistant materials but common materials to save the costs;
4) a number of fan blades are arranged between the upper disk and the lower disk of the fan wheel, the outer edge of the upper disk is also arranged with a number of fan blades, therefore the fan wheel has a reasonable layout and the double blade structure has a strong wind intake capability, effectively increasing the air intake volume; and 5) the blower volute has the advantages of simple structure and low cost, a rib is arranged on the inner wall of the cover body bottom and at both sides of the drainage hole top; the rib introduces the condensed water generated in the blower volute out through the drainage hole. The water drainage effect of is ideal. It ensures a stable performance of the blower in the air and is unable to cause a flame out of the combustion system of the whole set of the blower system even after a long-term service.

DETAILED DESCRIPTION OF THE EMBODIMENTS

This invention is explained in further detail below with the aid of the example embodiments and attached drawings.

Figure 1:
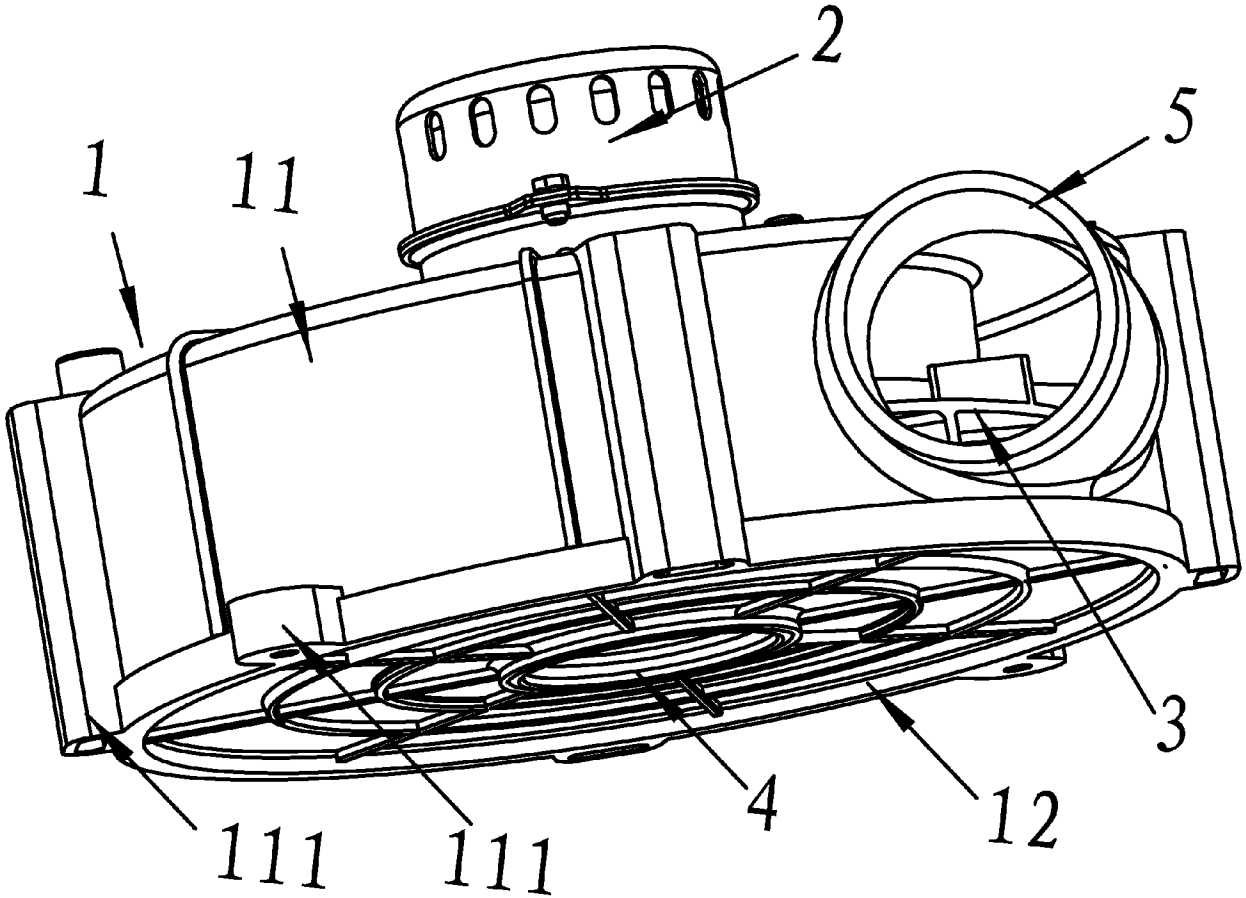
FIG. 1 is a three-dimensional view of a blower in accordance with one embodiment of the invention.
Figure 2:
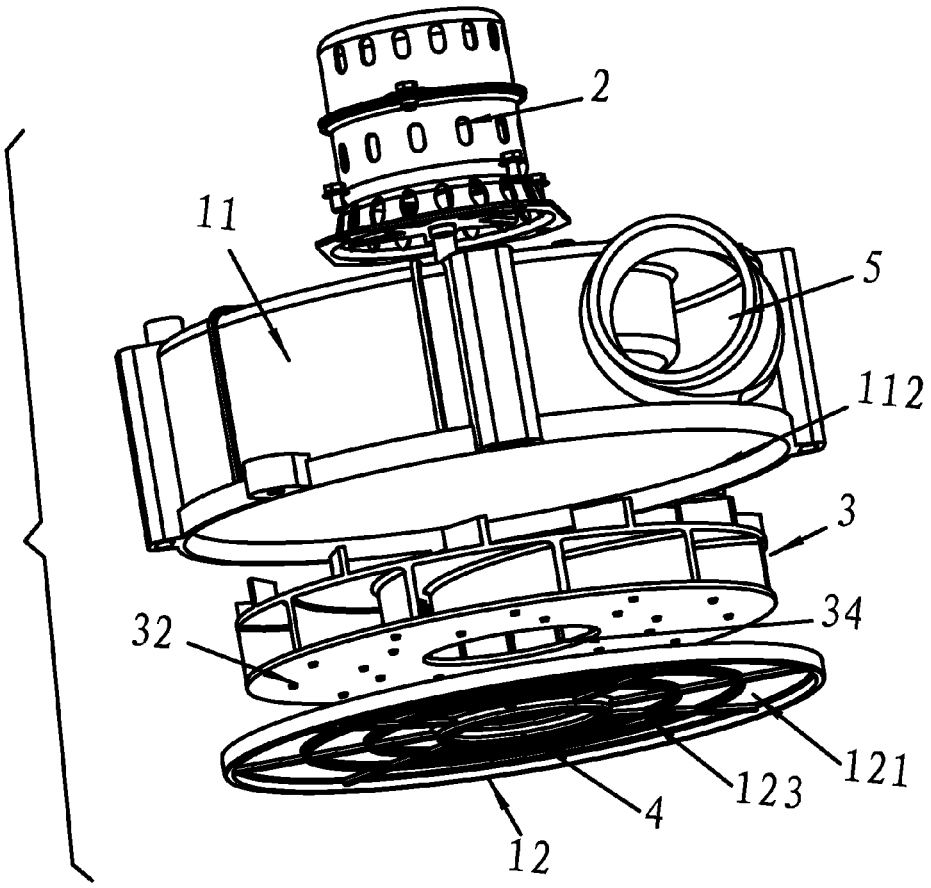
FIG. 2 is an exploded view of FIG. 1.
Figure 3:
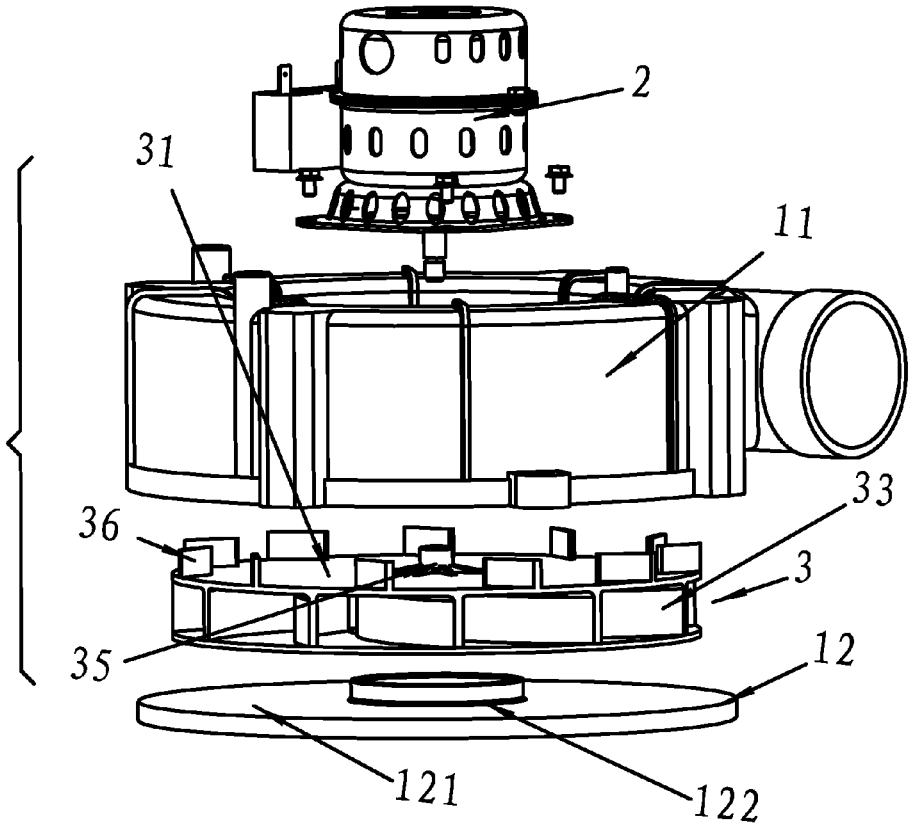
FIG. 3 is a structural view of FIG. 2 from another angle.
Figure 4:
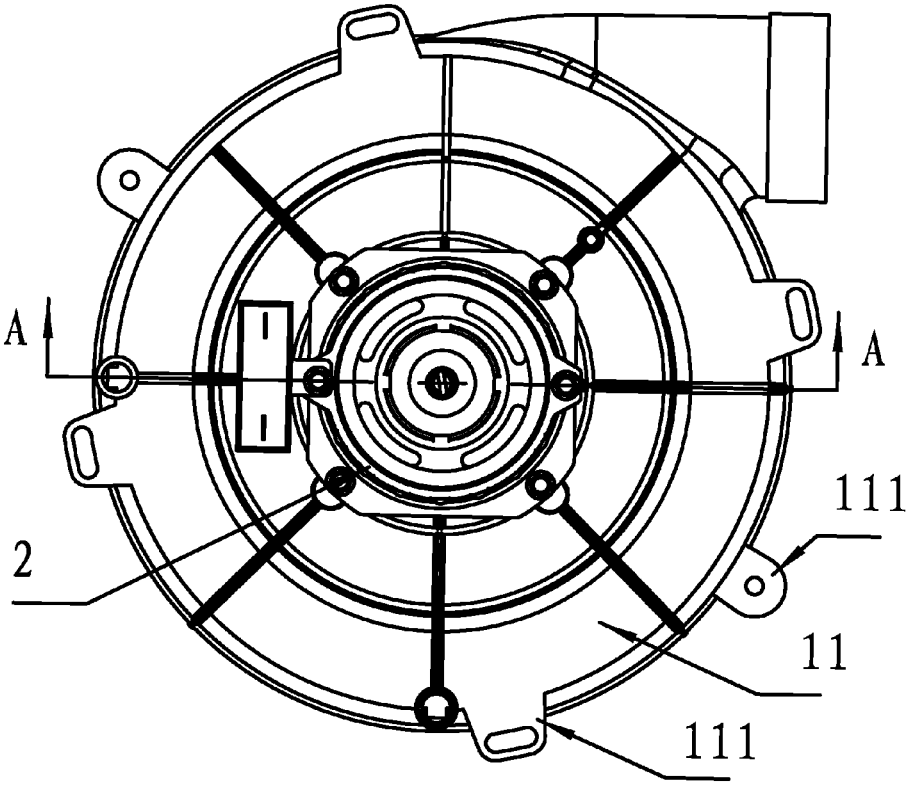
FIG. 4 is a plane view diagram of FIG. 1.
Figure 5:
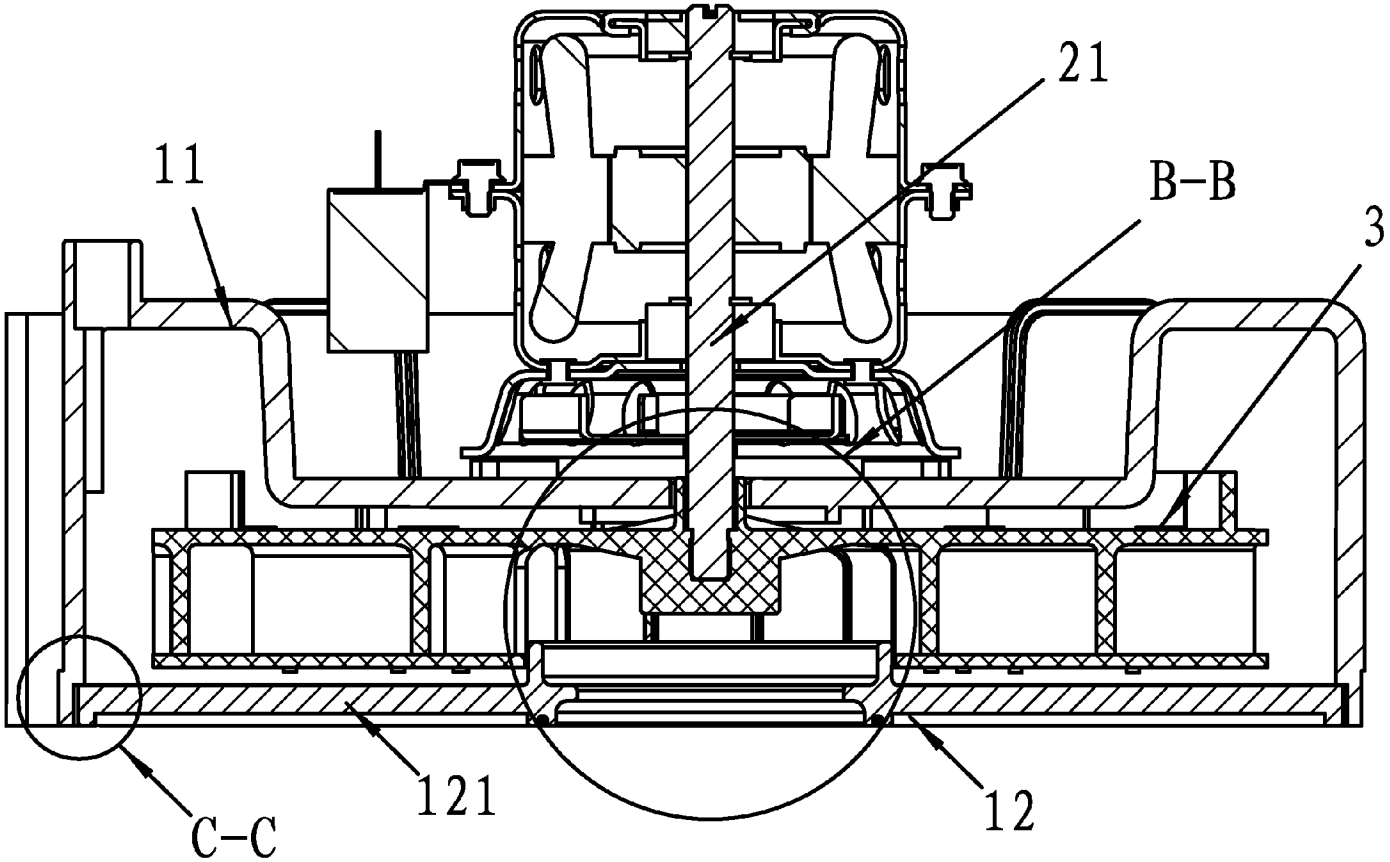
FIG. 5 is an A-A sectional view of FIG. 4.
Figure 6:
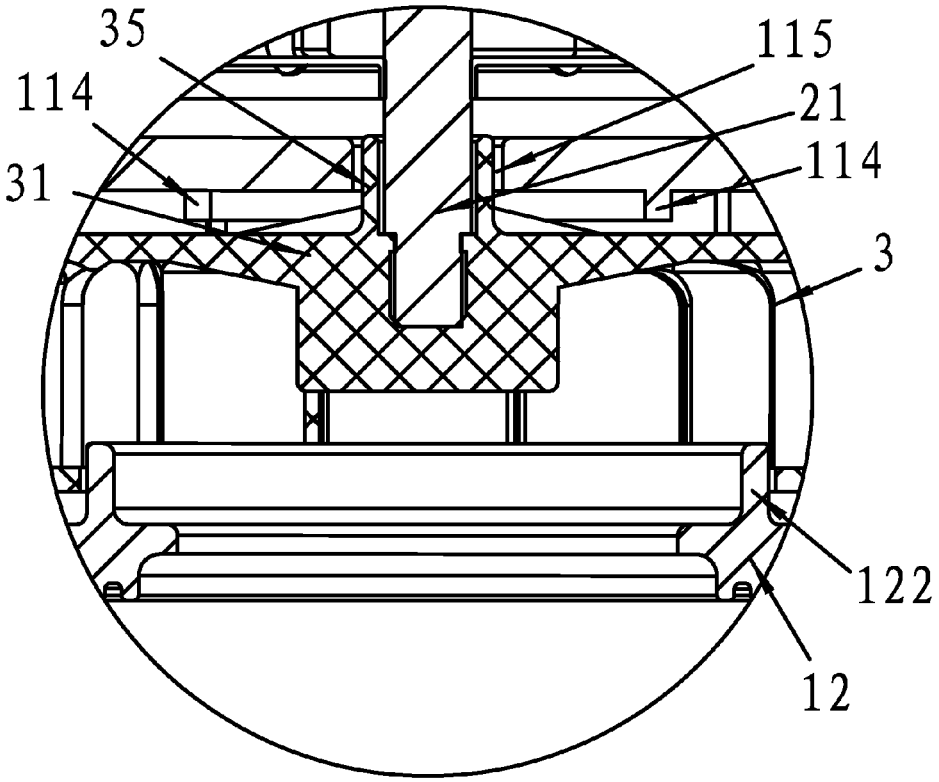
FIG. 6 is a B-B enlarged view of FIG. 5.
Figure 7:
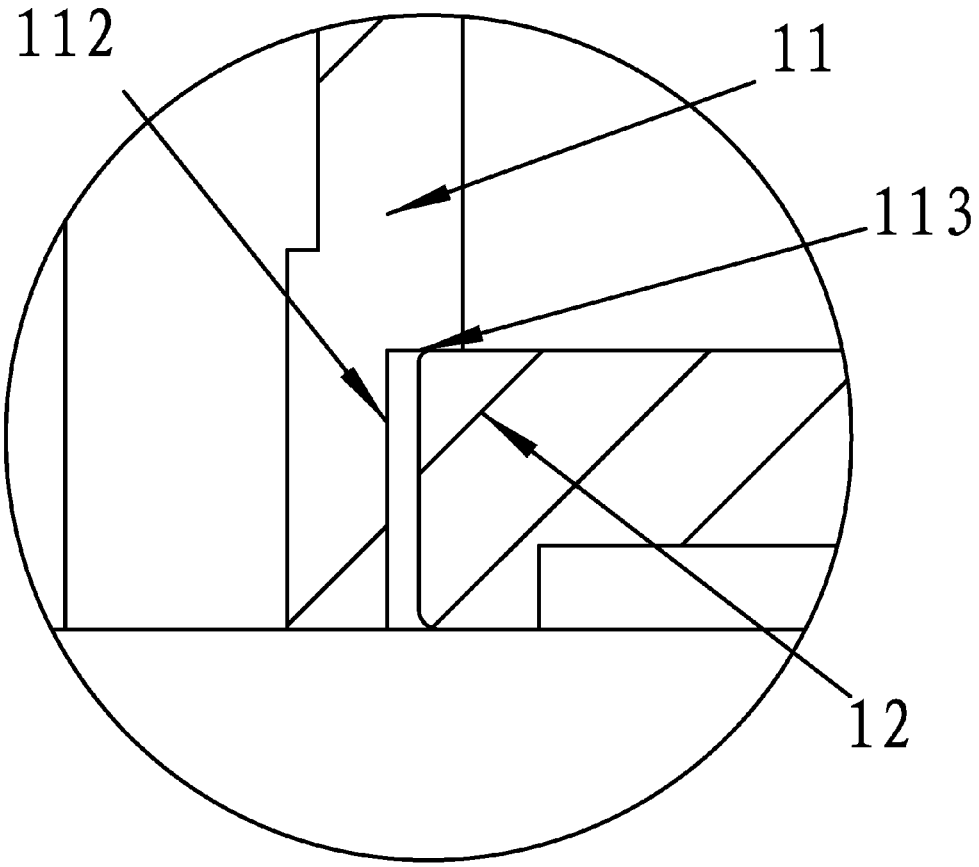
FIG. 7 is a C-C enlarged view of FIG. 5.
Figure 8:
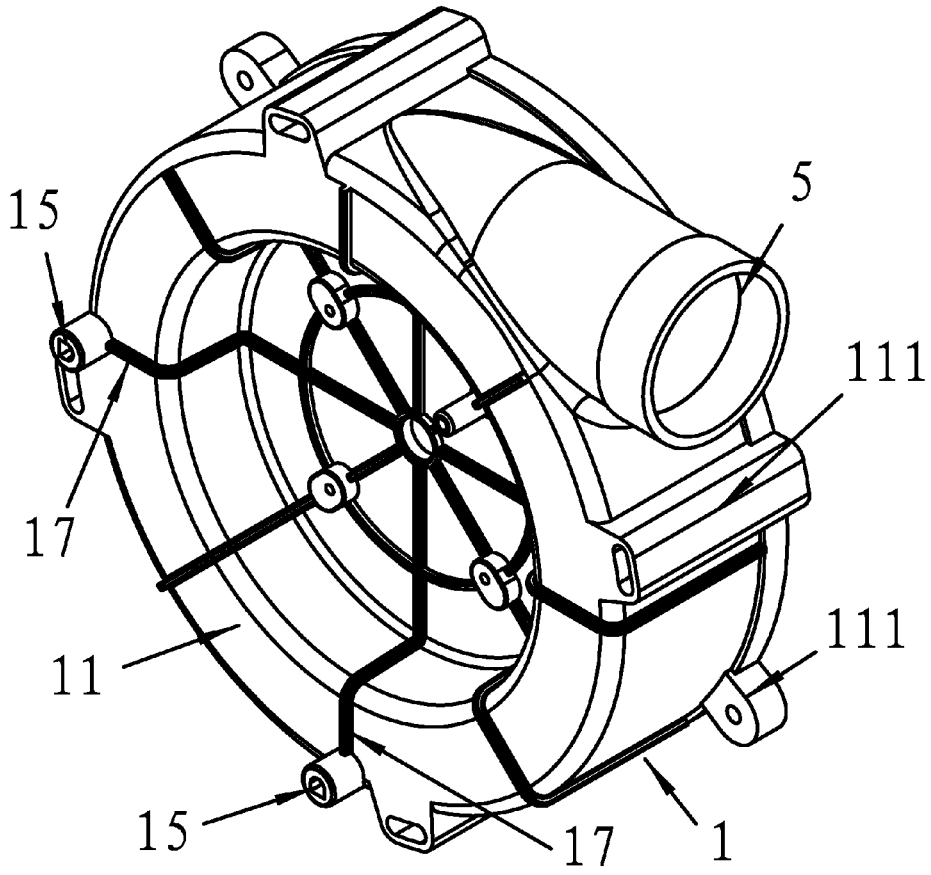
FIG. 8 is a three-dimensional diagram of a blower volute in accordance with one embodiment the invention.
Figure 9:
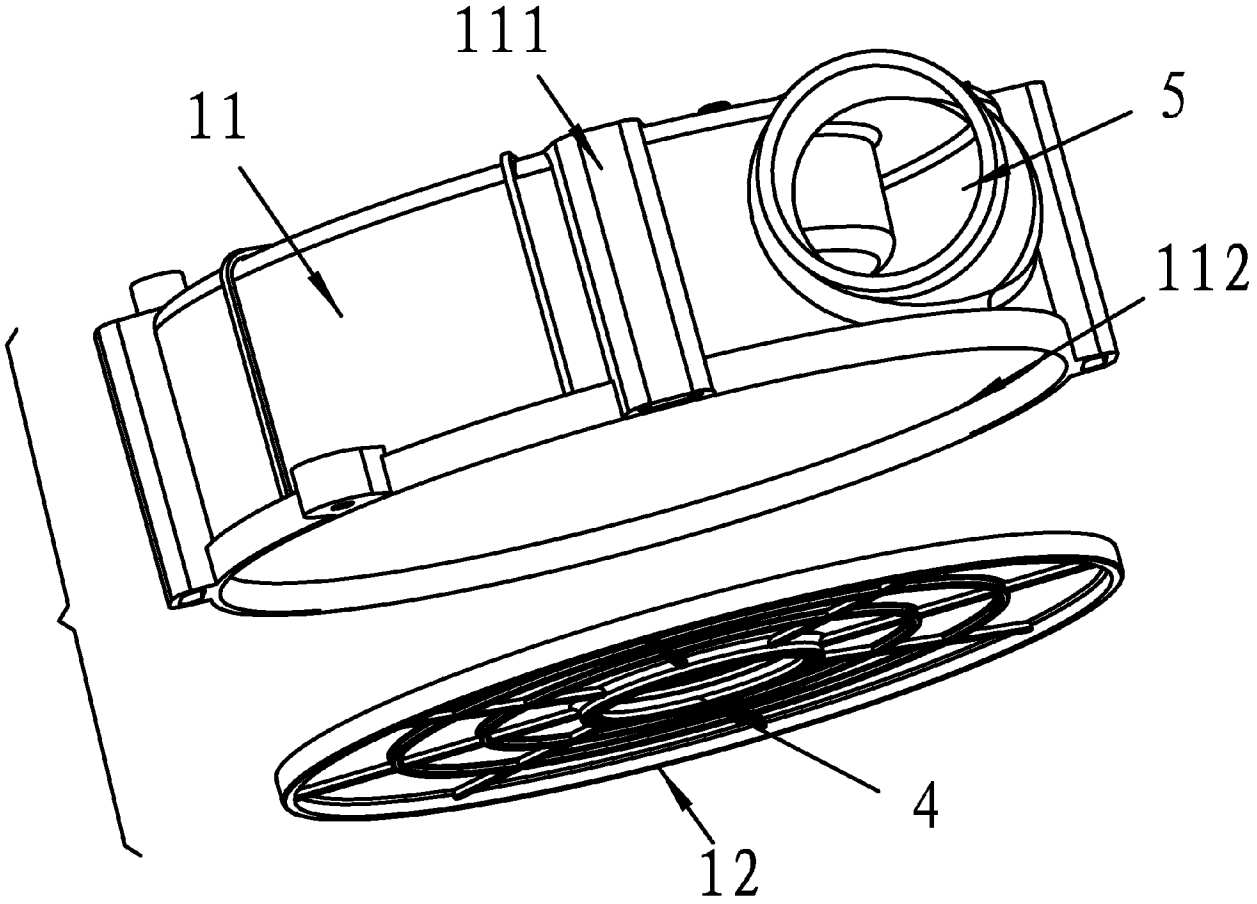
FIG. 9 is an exploded view of a blower volute.
Figure 10:
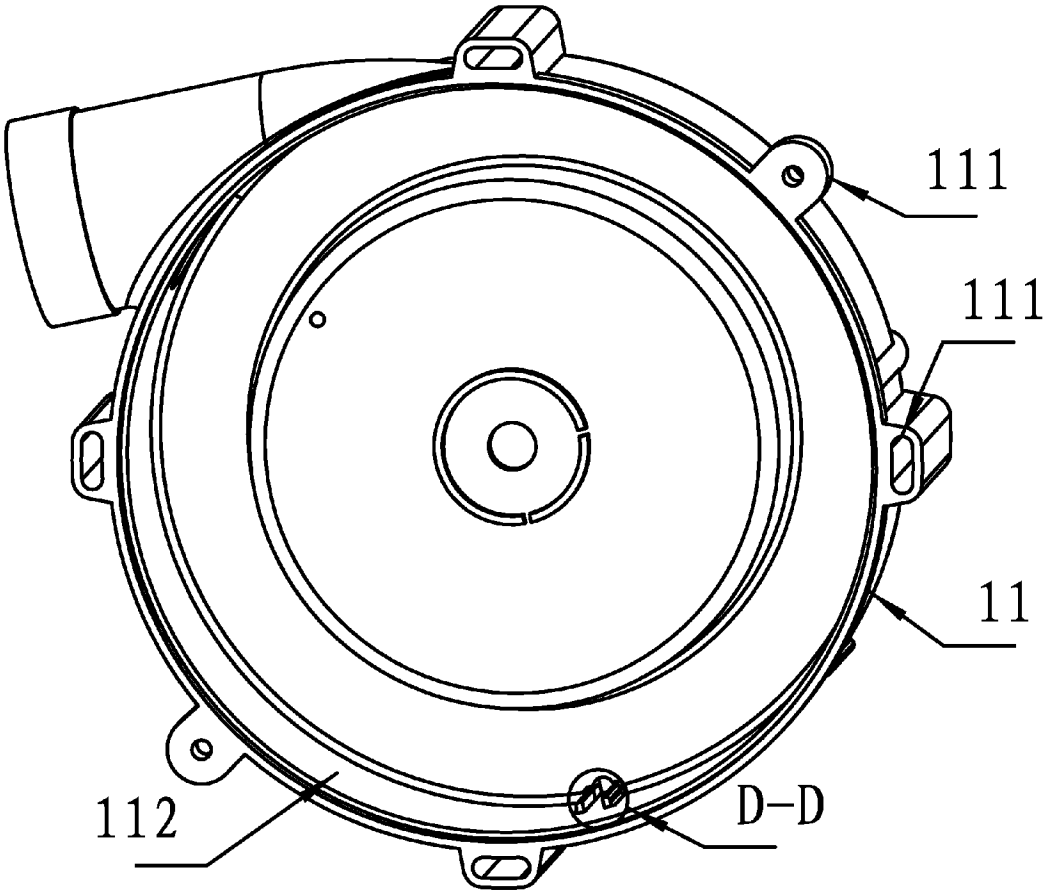
FIG. 10 is a structural view of a cover body after a bottom cover of a blower volute removed.
Figure 11:
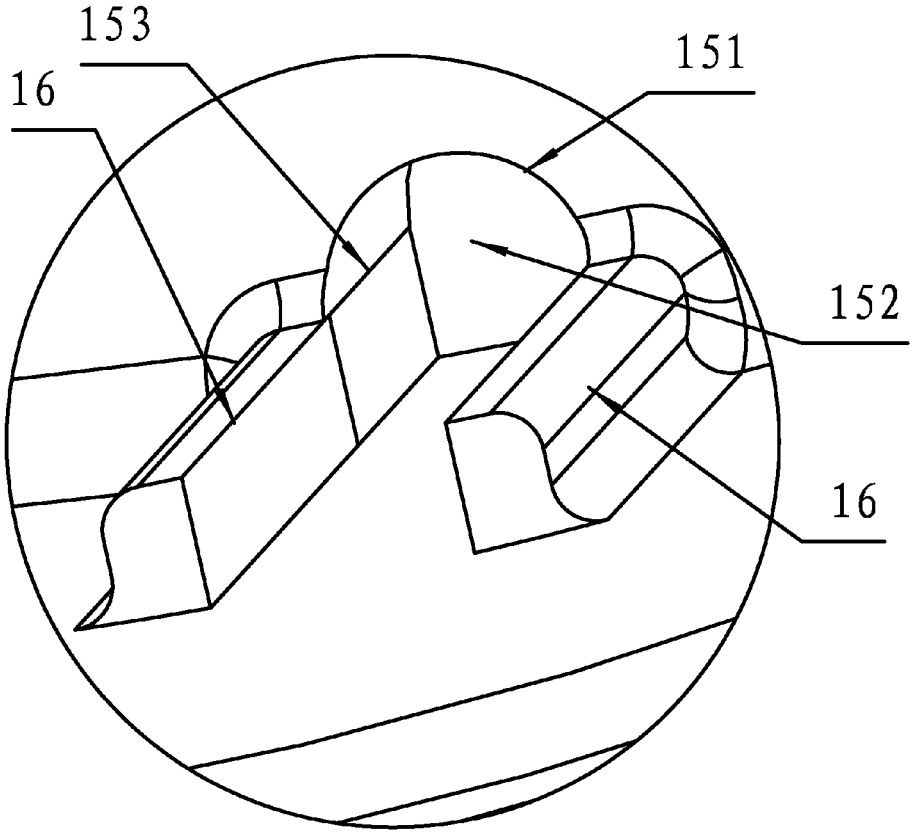
FIG. 11 is a D-D enlarged view of FIG. 10.
Figure 12:
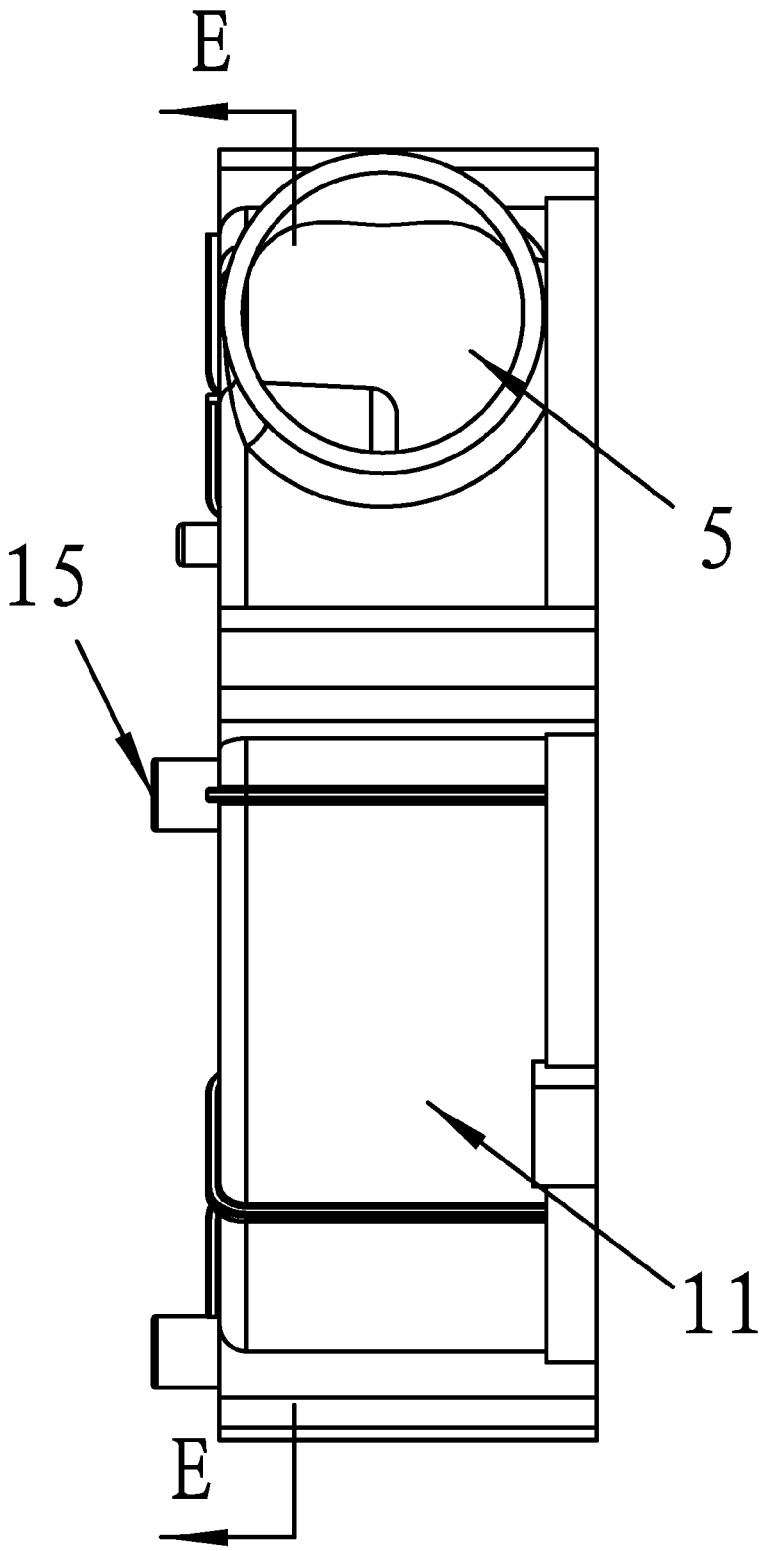
FIG. 12 is a side view of the cover body of FIG. 10.
Figure 13:
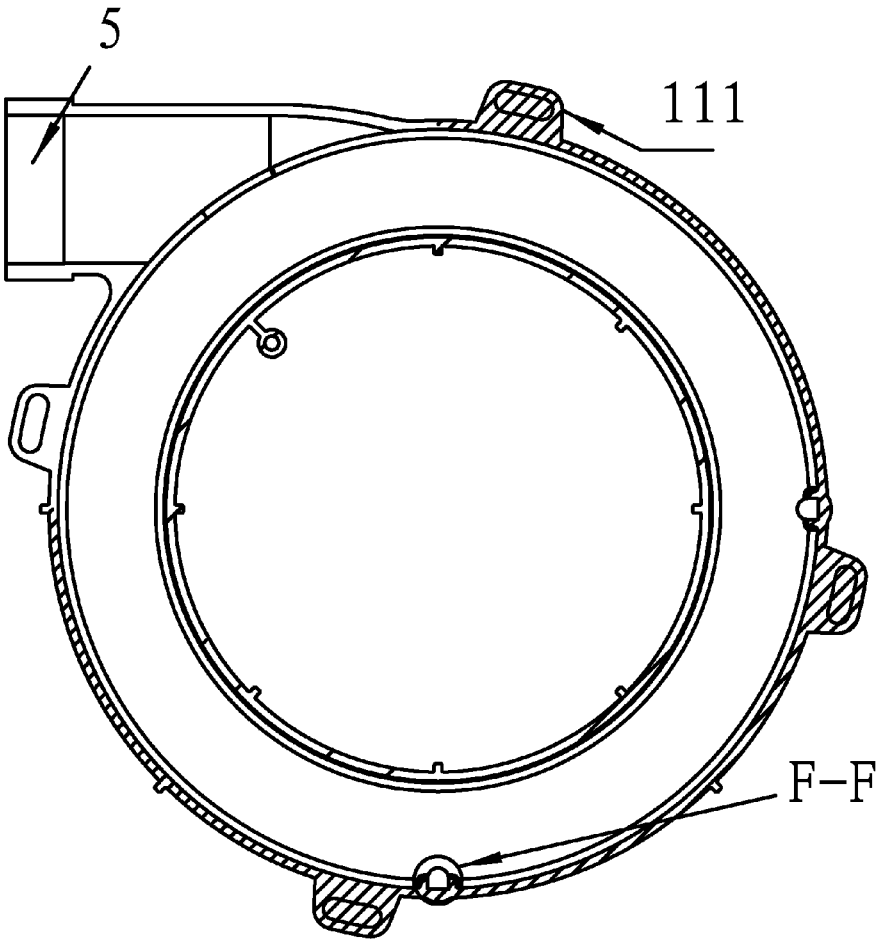
FIG. 13 is an E-E sectional view of FIG. 12.
Figure 14:
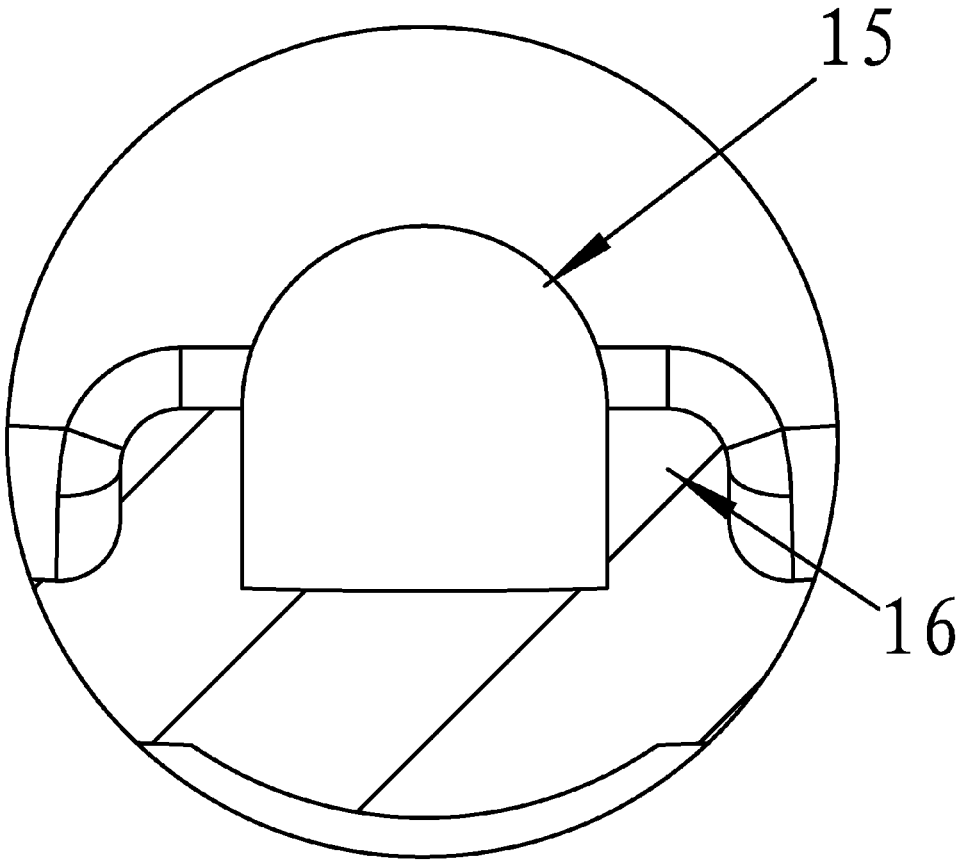
FIG. 14 is an F-F enlarged view of FIG. 13.
Figure 15:
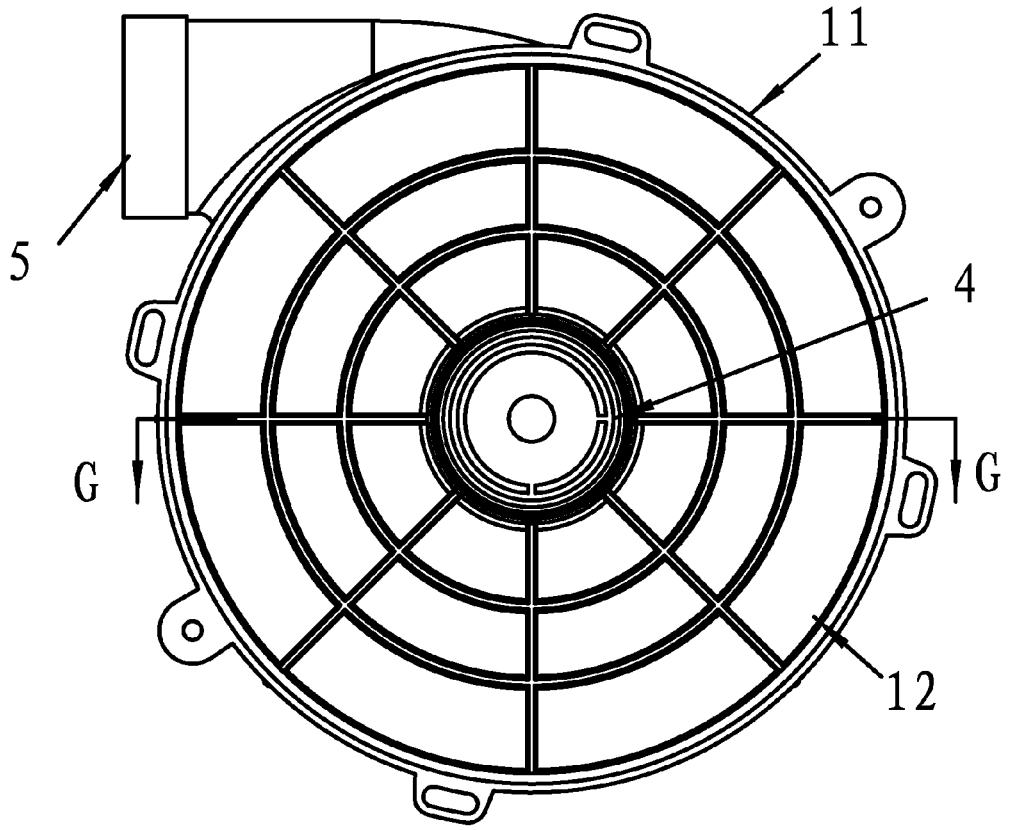
FIG. 15 is a plane view of the blower volute in accordance with the invention.
Figure 16:
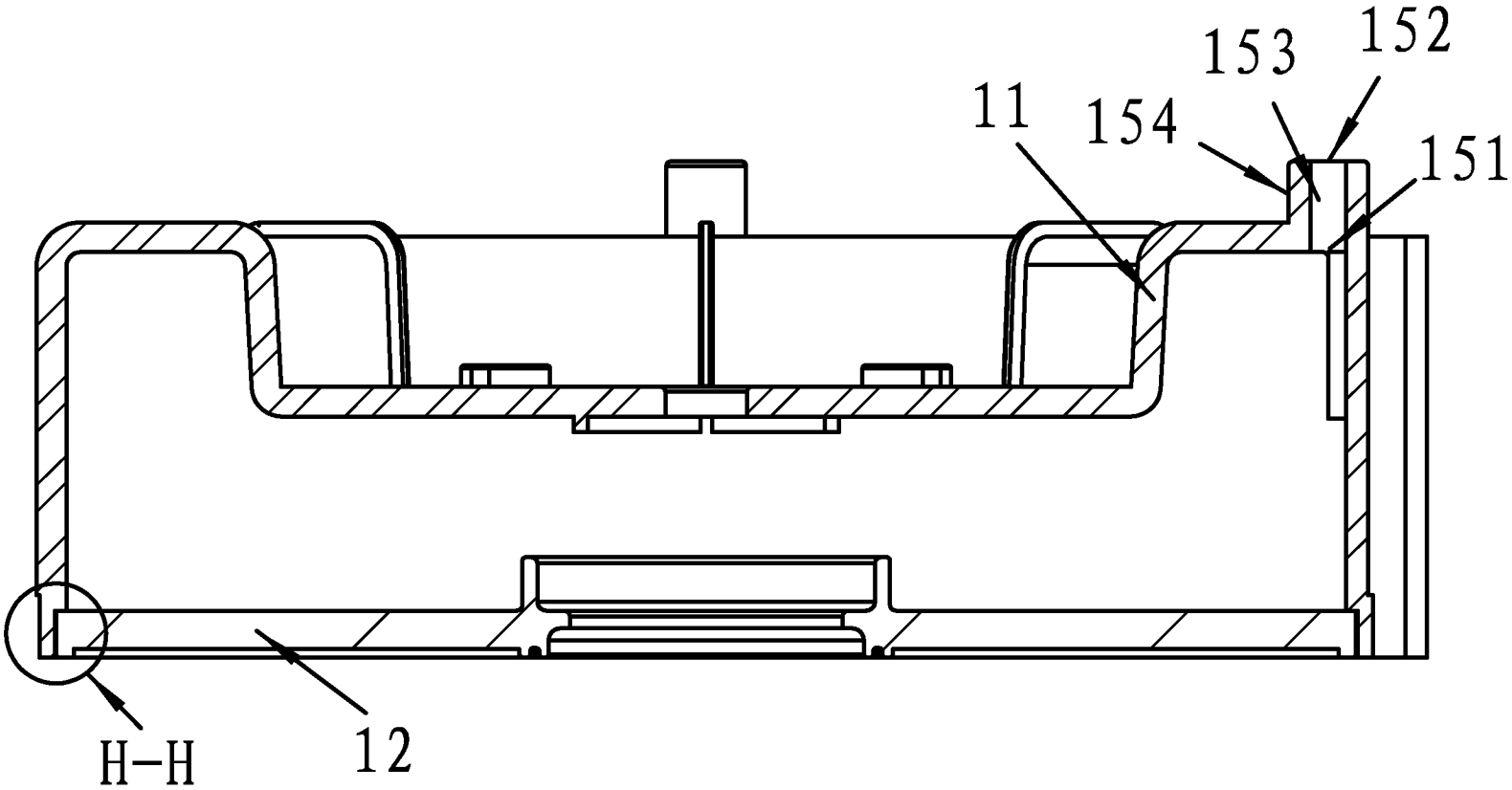
FIG. 16 is an G-G sectional view of FIG. 15.
Figure 17:
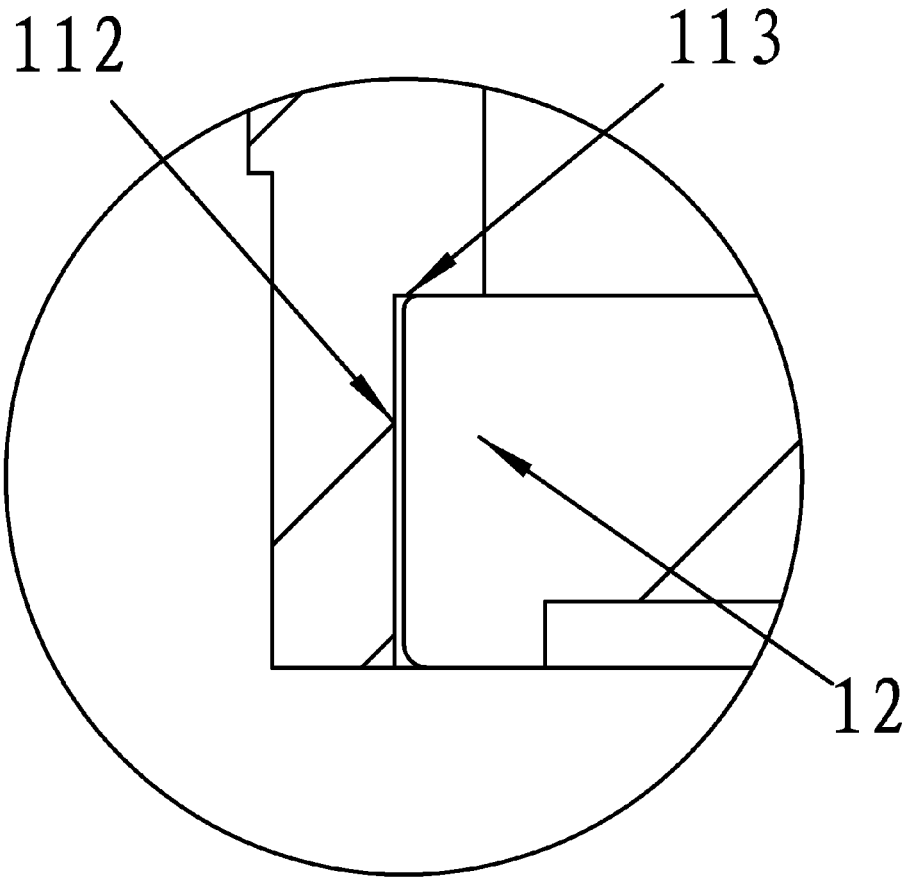
FIG. 17 is an H-H enlarged view of FIG. 16.

As shown in FIGS. 1-3, a blower is provided comprising a blower volute 1 arranged with an air inlet 4 and an air outlet 5, a blower motor 2 mounted at the top of the blower volute 1, and a fan wheel 3 arranged inside the blower volute 1 and connected to the blower motor 2. The blower volute 1 comprises a cover body 11 and a circular bottom cover 12, a plurality of installation parts 111 is arranged at outer side of the cover body 11, and the circular bottom cover 12 and the cover body 11 are embedded with each other and welded together or stuck together.

As shown in FIGS. 2-7, the circular bottom cover 12 is directly embedded into the inner wall 112 at the bottom of the cover body 11. The inner wall 112 is arranged with steps 113 and the top of the circular bottom cover 12 supports the steps 113. Both the bottom cover 12 and the inner wall 112 have a circular shape and the bottom of the bottom cover 12 is aligned with the bottom of the cover body 11. One side of the cover body 11 is arranged with an air outlet 5. The bottom cover 12 comprises a circular base plate 121 embedded on the inner wall 112 at the bottom of the cover body 11 and a convex ring body 122 arranged in the middle of the circular base plate 121. The air inlet 4 is arranged in the middle of the circular base plate 121. The convex ring body 122 is located at outer side of the air inlet 4. A plurality of reinforcing ribs 123 are arranged at bottom surface of the circular base plate 121 and outer edge of the air inlet 4. The fan wheel 3 comprises an upper disk 31, a lower disk 32, and a number of fan blades 33 arranged between the upper disk 31 and the lower disk 32. A through hole 34 is arranged in the middle of the lower disk 32 and the convex ring body 122 extends into the through hole 34 to fill the gap. A shaft sleeve 35 is arranged in the middle of the upper disk 31, the shaft sleeve 35 is tightly connected to the shaft extension end of a rotating shaft 21 of the blower motor 2 and the shaft sleeve 35 is embedded into the central through hole 115 on the top of the cover body 11. The top inner wall of the cover body 11 is also arranged with a convex portion 114 located at outer side of the shaft sleeve 35 and closed to the end surface of the upper disk 31, which has a good sealing effect for the shaft sleeve 35 and the shaft extension end of the rotating shaft 21, thus effectively prevent the shaft sleeve 35 and the rotating shaft 21 from being corroded by condensed water vapor. The outer edge of the upper disk 31 is also arranged with a number of fan blades 36.

The upper disk 31 and the lower disk 32 are either welded together or stuck together and the number of fan blades 36 is 8-12 pieces.

As shown in FIGS. 8-17, the blower volute is arranged with the air inlet 4 and the air outlet 5. At least one drainage hole 15 is arranged on the inner wall of the blower volute 1 and one rib 16 is both arranged on the inner wall of the blower volute 1 and at both sides of the drainage hole 15 top. The rib 16 introduces the condensed water generated in the blower volute out through the drainage hole 15. The drainage hole 15 comprises a gully hole 151, a drain outlet 152, and a diversion section 153 located between the gully hole 151 and the drain outlet 152. The gully hole 151, the drain outlet 152, and the diversion section 153 have the same cross-sectional shape and size. The rib 16 is arranged at side of the gully hole 151 and perpendicularly connected to the side edge of the gully hole 151. The outer edge of the diversion section 153 forms a tubular body 154 extending out of the blower volute 1. The outside of the tubular body 154 is arranged with the reinforcing rib 17. The blower volute 1 comprises a cover body 11 and a circular bottom cover 12. A plurality of installation parts 111 are arranged at outer side of the cover body 11. The circular bottom cover 12 and the cover body 11 are either welded together or stuck together. The air inlet 4 is arranged in the middle of the circular bottom cover 12. The circular bottom cover 12 is directly embedded into the circular inner wall 112 at the bottom of the cover body 11. The circular inner wall 112 is arranged with steps 113 and the top of the circular bottom cover 12 supports the steps 113. One side of the cover body 11 is arranged with the air outlet 5. A drainage hole 15 is arranged on the edge of the top side wall of the cover body 11 and the cross section of the drainage hole 15 is a U-shape.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A blower, comprising:

a) a blower volute;

b) a blower motor; and c) a fan wheel;

wherein the blower motor is disposed at the top of the blower volute;

the fan wheel is disposed inside the blower volute and connected to the blower motor;

the blower volute comprises an air inlet, an air outlet, a cover body, and a bottom cover;

a plurality of installation parts are disposed at an outer side of the cover body;

the bottom cover is embedded within the cover body; and the bottom cover and the cover body are welded together;

the bottom cover comprises a circular base plate embedded into an inner wall of a bottom of the cover body and a convex ring body located in a middle of the circular base plate; the air inlet is disposed in the middle of the circular base plate and the convex ring body is located at an outer side of the air inlet;

a bottom surface of the circular base plate and outer edges of the air inlet are provided with a plurality of reinforcing ribs;

the fan wheel comprises an upper disk, a lower disk, and a plurality of fan blades disposed between the upper disk and the lower disk; a through hole is arranged in a middle of the lower disk and the convex ring body extends into the through hole;

a shaft sleeve is arranged in a middle of the upper disk;

the shaft sleeve is tightly connected to a shaft extension end of a rotating shaft of the blower motor;

the shaft sleeve is embedded into a central through hole disposed at the top of the cover body;

a top inner wall of the cover body is arranged with a convex portion located at an outer side of the shaft sleeve and disposed above an end surface of the upper disk;

the outer edge of the upper disk is arranged with a plurality of fan blades; and the upper disk and the lower disk are either welded together; and a number of the fan blades is 8-12.

2. A blower, comprising:

a) a blower volute;

b) a blower motor; and c) a fan wheel;

wherein:

the blower motor is disposed at a top of the blower volute;

the fan wheel is disposed inside the blower volute and connected to the blower motor;

the blower volute comprises an air inlet, an air outlet, a cover body, and a bottom cover;

a plurality of installation parts are disposed at an outer side of the cover body;

the bottom cover is embedded within the cover body; and the bottom cover and the cover body are welded together;

the bottom cover is directly embedded into an inner wall of a bottom of the cover body; the inner wall is arranged with steps and a top of the bottom cover supports the steps;

both the bottom cover and the inner wall have a circular shape and a bottom of the bottom cover is aligned with that of the cover body;

the air outlet is disposed at one side of the cover body;

the bottom cover comprises a circular base plate embedded into the inner wall of the bottom of the cover body and a convex ring body located in a middle of the circular base plate; the air inlet is disposed in the middle of the circular base plate and the convex ring body is located at an outer side of the air inlet;

a bottom surface of the circular base plate and outer edges of the air inlet are provided with a plurality of reinforcing ribs;

the fan wheel comprises an upper disks, a lower disk, and a plurality of fan blades disposed between the upper disk and the lower disk; a through hole is arranged in a middle of the lower disk and the convex ring body extends into the through hole;

a shaft sleeve is arranged in a middle of the upper disk;

the shaft sleeve is tightly connected to a shaft extension end of a rotating shaft of the blower motor;

the shaft sleeve is embedded into a central through hole disposed at the top of the cover body;

a top inner wall of the cover body is arranged with a convex portion located at an outer side of the shaft sleeve and disposed above an end surface of the upper disk;

the outer edge of the upper disk is arranged with a plurality of fan blades; and the upper disk and the lower disk are welded together; and a number of the fan blades is 8-12.

3. A blower, the blower comprising:

a) a blower volute;

b) a blower motor; and c) a fan wheel;

wherein the blower motor is disposed at a top of the blower volute;

the fan wheel is disposed inside the blower volute and connected to the blower motor;

the blower volute comprises an air inlet, an air outlet, a cover body, and a bottom cover;

a plurality of installation parts are disposed at an outer side of the cover body;

the bottom cover is embedded within the cover body; and the bottom cover and the cover body are welded together;

the cover body is arranged with at least one drainage hole, the drainage hole having two top sides; a rib is arranged both on an inner wall of the bottom of the cover body and at the two top sides of the drainage hole; and the rib introduces a condensed water generated in the blower volute out through the drainage hole; and the drainage hole comprises a gully hole, a drain outlet, and a diversion section located between the gully hole and the drain outlet; the gully hole, the drain outlet, and the diversion section have the same cross-sectional shape and size; and the rib is arranged at one side of the gully hole and perpendicularly connected to a side edge of the gully hole.

4. The blower of claim 3, wherein an outer edge of the diversion section forms a tubular body extending out of the blower volute and a reinforcing rib is arranged outside the tubular body.

* * * * *